US006243940B1

(12) United States Patent
Rund et al.

(10) Patent No.: US 6,243,940 B1
(45) Date of Patent: Jun. 12, 2001

(54) LASER GAPPING OF MAGNETIC CORES

(76) Inventors: Larry D. Rund, 54165 Linger La., Idyllwild, CA (US) 92549; Richard P. Hewitt, 30210 Norden Dr., Ramoland, CA (US) 92585; Stuart O. Sigafoos, 1908 W. Acacia Ave., Apt. 81, Hemet, CA (US) 92545

( * ) Notice: Subject to any disclaimer, the term of this patent is extended or adjusted under 35 U.S.C. 154(b) by 0 days.

(21) Appl. No.: 09/310,025

(22) Filed: May 11, 1999

(51) Int. Cl.[7] ..... H01F 41/02

(52) U.S. Cl. ..... 29/608; 29/602.1; 219/121.69; 219/121.71

(58) Field of Search ..... 29/607, 608, 609, 29/602.1, 605, 606; 219/121.7, 121.71, 121.68, 121.69

(56) References Cited

U.S. PATENT DOCUMENTS 3,507,039 * 4/1970 Craige ..... 29/602.1 X
4,267,427 * 5/1981 Nomura et al. ..... 29/607 X

FOREIGN PATENT DOCUMENTS 42 34 342 A1 * 4/1994 (DE) .

* cited by examiner

*Primary Examiner*—Carl E. Hall
(74) *Attorney, Agent, or Firm*—Clyde R Christofferson

(57) ABSTRACT

A method of gapping a ferrite core by coating the core with a stabilizing material, fracturing the core with a laser beam thereby creating one or more gaps in the core's magnetic field, optionally opening the fracture to obtain a desire inductance, and then sealing the core.

9 Claims, 7 Drawing Sheets

LASER GAPPING OF MAGNETIC CORES

BACKGROUND OF THE INVENTION

1. Field of the Invention

The present invention generally relates to methods for avoiding DC current magnetization in magnetic cores, and in particular to use of lasers in the manufacture of magnetic cores so as to break DC magnetizing paths in the cores.

2. Background Description

In the design of magnetic devices, both the alternating and direct current affect the characteristics of the device. When discussing magnetic materials, they are referred to as being "hard" or "soft". Hard materials retain their magnetism after a magnetic field has been applied; e.g. steel. These materials' molecular particles line up their magnetic poles to create magnetic lines of flux, and they stay lined up thereby creating a permanent magnet. Soft materials will magnetize, but will not retain the magnetic properties: their molecular particles will scramble when the magnetic field is removed, leaving the material in its original, non-magnetized state.

Transformers need to be made with soft materials: the magnetic particles must be able to switch direction quickly to concentrate the winding field. A magnetized core will inhibit the transformer action. In practical transformer circuits, it is sometimes necessary to allow a direct current (DC) to flow through a winding. This DC component magnetizes the core and adversely affects the properties of the transformer. To counteract the effects of the direct current, the core must be "gapped", i.e. physically broken so that it does not provide a magnetic path in a complete, continuous circle. This gap breaks the magnetic flux inside the core so as to keep the core material from aligning with the direct current, freeing the material to align with the alternating current, i.e. the signal which is to be operated on by the transformer. The amount of gap is dependent upon the operating characteristics required by the transformer. Among other parameters, the inductance of the core is indirectly proportional to the width of the gap. Direct current capacity (i.e. the ability to handle direct current in the windings without saturating the core) is directly proportional to the width of the gap. High frequency circuits usually need lower inductance, so gapped cores find many uses, such as in switch mode power supplies which have higher direct current. These parameters must be addressed in the final circuit design.

In the prior art, the core gapping process would physically break the core (e.g. as shown at junction 21 in FIG. 2A) into pieces 22 as shown in FIG. 2A and re-assemble the pieces 22 with gapping paper or other non-magnetic material 23 as shown in FIG. 2B, using an adhesive. Cores gapped using this method require fixturing to hold the core in position while the adhesive cures. Cores may also be sliced (with a saw blade) on one side, and filled with an adhesive material. These methods are slow and time consuming. Further, when a manufacturing process involves multiple cores it is necessary to assure that the pieces match when reassembled. Also, the core material is brittle and may crack or chip at undesired locations, producing extra gaps and rendering the core useless. The core surface must be maintained to allow the winding of wire over the core without interference. When gapping cores less than 0.5 inches in diameter, this process becomes difficult due to the small size of the core, which makes it difficult to hold the core in position during the curing phase.

SUMMARY OF THE INVENTION

It is therefore an object of the present invention to provide an efficient and inexpensive method of core gapping, particularly for small ferrite cores.

The present invention is a method for gapping a magnetic core, particularly applicable for small toroid cores less than 0.5 inches in diameter, by coating the core with a stabilizing material, fracturing the core with a laser beam, opening the fracture to set a desired inductance, and sealing the core gap. The core is opened by inserting a wedge into the core internal diameter and using the wedge to spread apart the fracture, meanwhile monitoring the inductance of the core until a desired inductance is reached. A conductor through the center of the core is sufficient to measure the inductance. The core gap is then sealed by submersion in a low viscosity adhesive (e.g. epoxy) bath in a vacuum, then returning the submerged core to atmospheric pressure, thereby impregnating the fracture with epoxy. The core is then removed from the epoxy bath, cleaned of excess epoxy and cured in an oven. Optionally, before curing, the inductance is checked and adjusted.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1A:
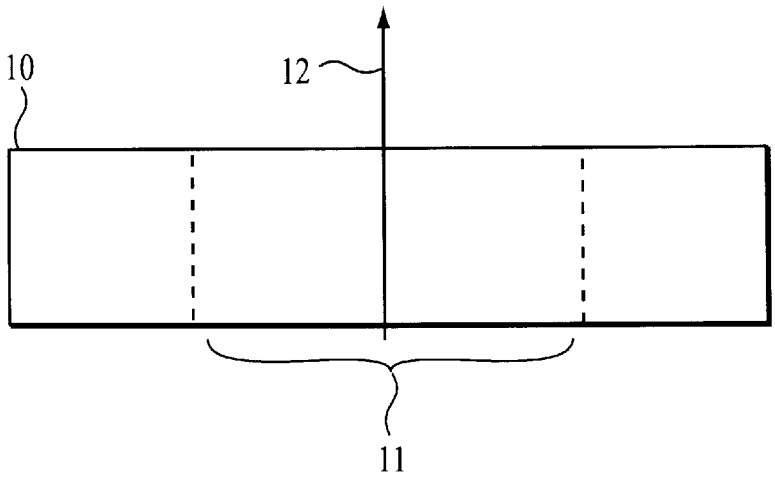
FIG. 1A is a side view of a toroidal ferrite core.
Figure 1B:
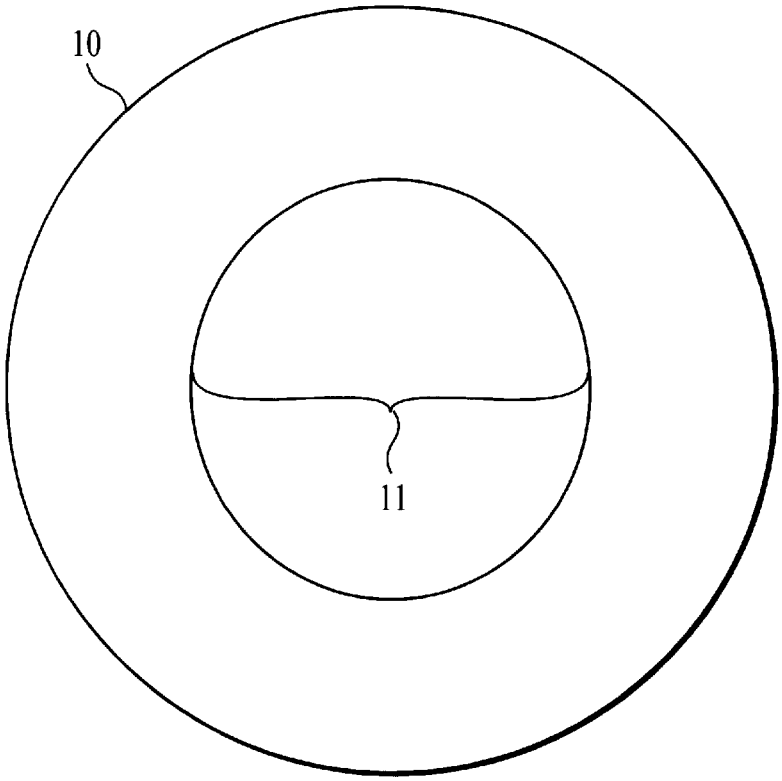
FIG. 1B is a top view of a toroidal ferrite core.
Figure 2A:
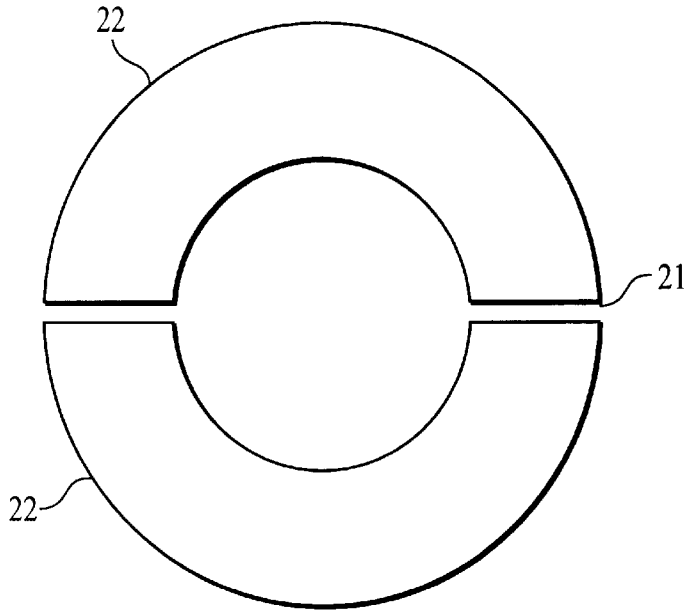
FIG. 2A PRIOR ART
FIG. 2A shows a toroidal ferrite core cut in half in accordance with a prior art technique.
Figure 2B:
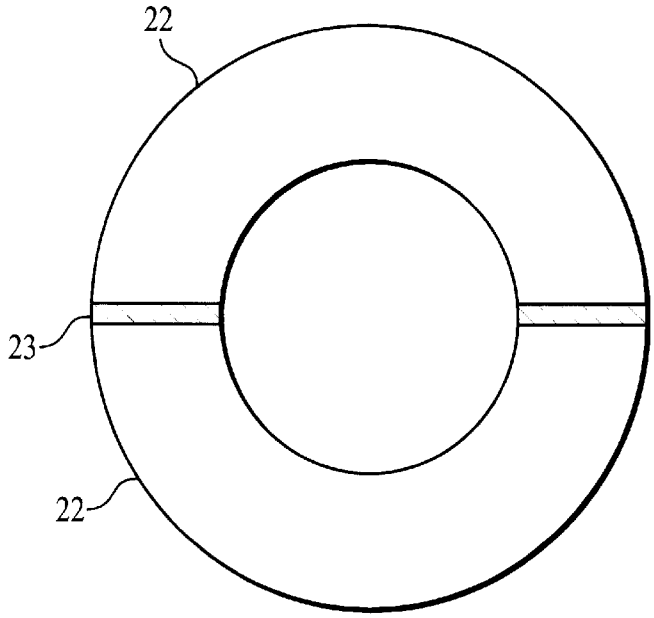
FIG. 2B PRIOR ART
FIG. 2B shows ferrite core halves assembled together with adhesive to establish a gap in accordance with the prior art.

Referring now to the drawings, and more particularly to FIG. 1A, there is shown a side view of a typical toroidal ferrite core 10 having an interior diameter 11 and a toroidal axis 12. A top view of the core is shown in FIG. 1B.

The first step in practice of the invention is to coat the ferrite core with a stabilizing material providing the properties necessary to complete the remaining steps. In particular, the stabilizing material a) must hold the ferrite core together when the core is fractured with a laser, so that the core does not separate completely; b) must maintain a seal over the surface of the core, including i) a seal over sharp edges at the point of fracture, when the fracture is expanding during the gapping step, and ii) a seal at the edges of the core so that the edges do not pierce the insulation on the wire used to wrap the core in typical transformer applications; c) must maintain openings in the seal created by the laser, so that epoxy or other adhesive may be flowed into the expanded fracture to set the gap; and d) must be pliable but without memory so that the core is able to expand without the coating squeezing it back together again, hence, closing the gap. One material having these properties is parylene, but other suitable materials may also be used.

Figure 3A:
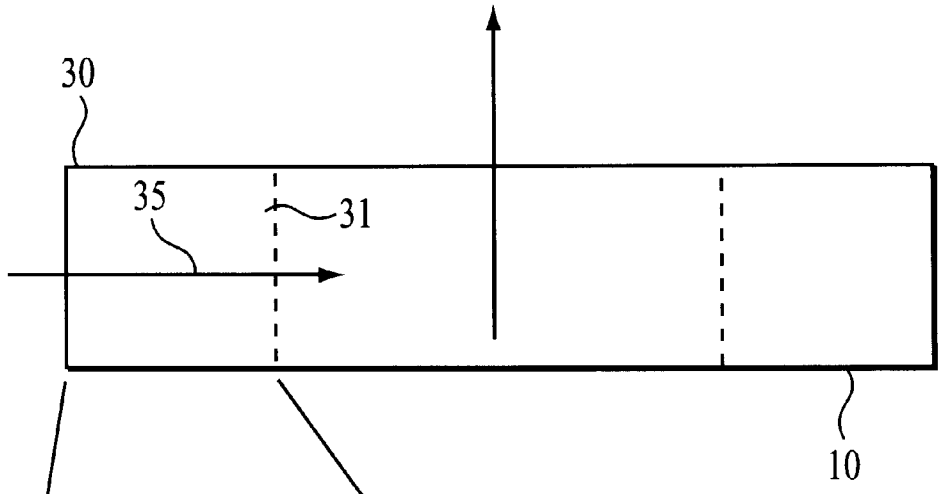
FIG. 3A shows a cross section of a toroidal ferrite core.
Figure 3B:
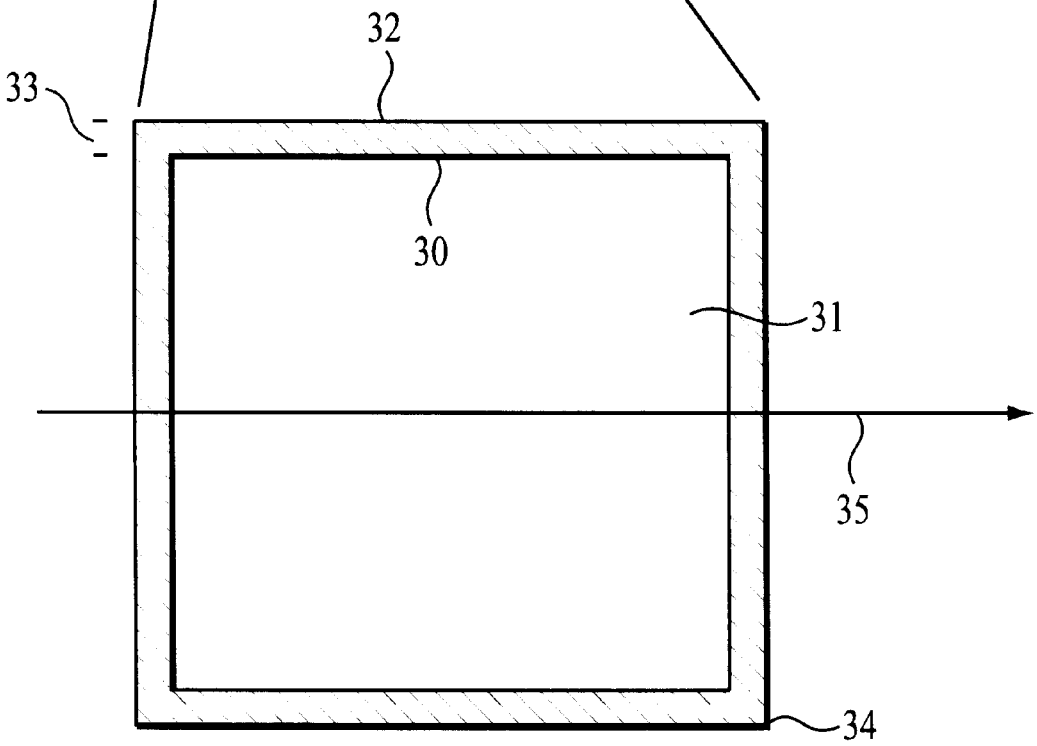
FIG. 3B shows an enlarged view of one side of the toroid after coating with parylene in accordance with the present invention.

The coating step may be understood with reference to FIGS. 3A and 3B, to which we now turn. A side view of the core 10 is shown in FIG. 3A, with a ferrite surface 30. The coating may be applied with a vacuum deposition process or other process known in the art. For small ferrite cores of a quarter inch diameter, a suitable coating thickness is between two tenths of mil (0.0002 inches) and five mils (0.005 inches) of parylene. A cross section 31 of core 10 is enlarged as shown in FIG. 3B with reference to alignment arrow 35 to show the coating as a shaded area around the outside of the core surface 30, with a thickness 33 between the core surface 30 and the outer surface 32 of the coating. Note that the coating material maintains the integrity of the seal over the edge 34.

Figure 4A:
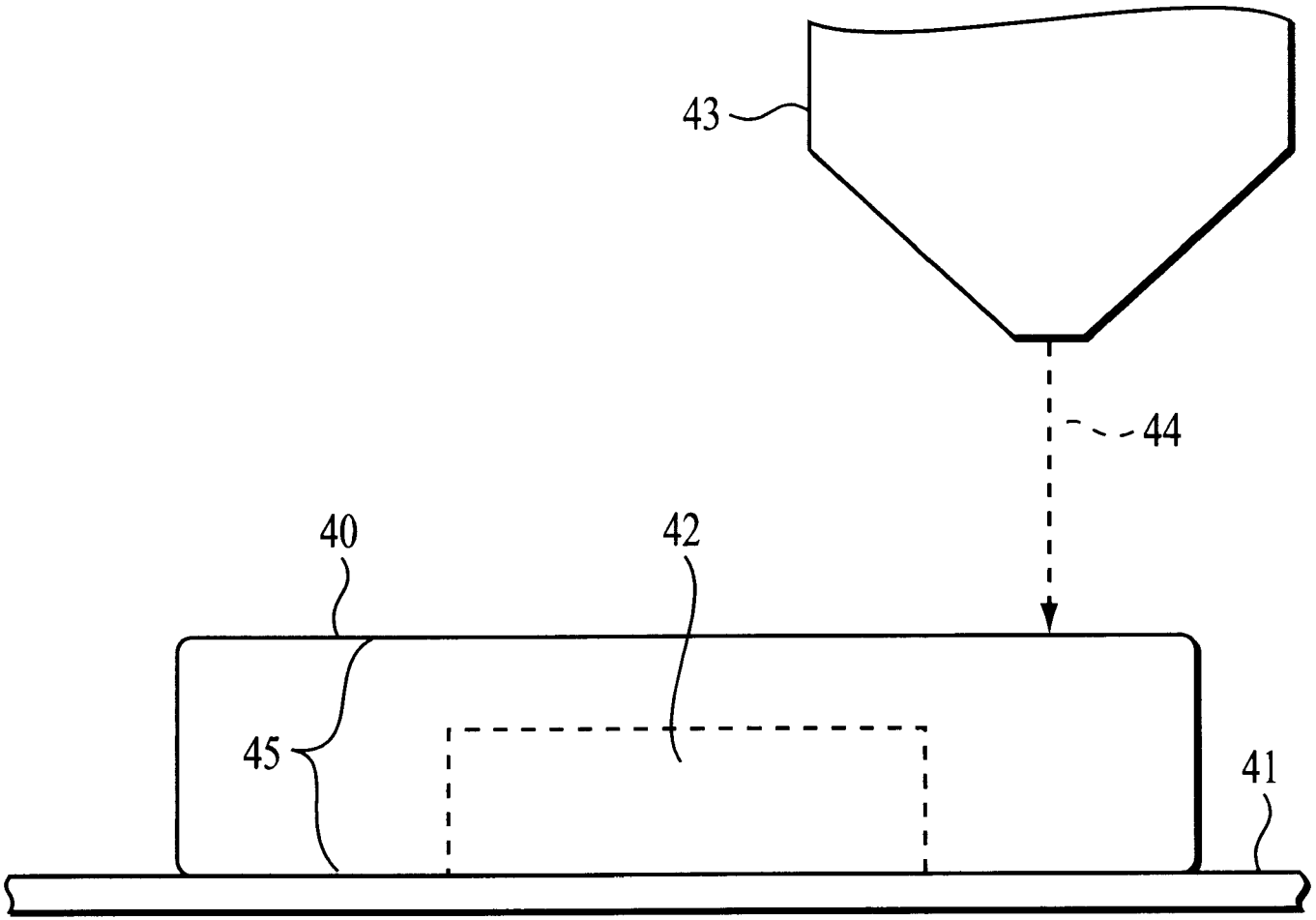
FIG. 4A shows a side view of a coated toroidal ferrite core mounted in position for application of a laser in accordance with the present invention.

Turning now to FIG. 4A, the coated core is positioned in preparation for the laser fracturing step. Each core must be held in place so that it can be struck with a laser beam. For example, robotic means can be used to pick cores from a bowl feeder (not shown) and place each of them on a platform 41 to be held in place while the core is hit by a laser in one or multiple places, depending on the gapping required. As shown in FIG. 4A, a surface 41 may have a button 42 sized just smaller than inside diameter 11 of the core, with the coated core 40 being placed thereon by robotic means and thereby aligned in position for use of a laser 43 to generate a laser beam (indicated by broken arrow 44) parallel to core axis 12 to crack the core at one of the core's horizontal surfaces 45. Preferably, this will be done in several places around the toroidal surface of the core, to provide optimum results, depending upon the inductance desired, for the finished core.

As will be evident to those skilled in the art, other methods of fixturing may be used, allowing use of multiple lasers and striking the core at multiple locations on either or both horizontal surfaces as well as the outer surface.

Figure 4B:
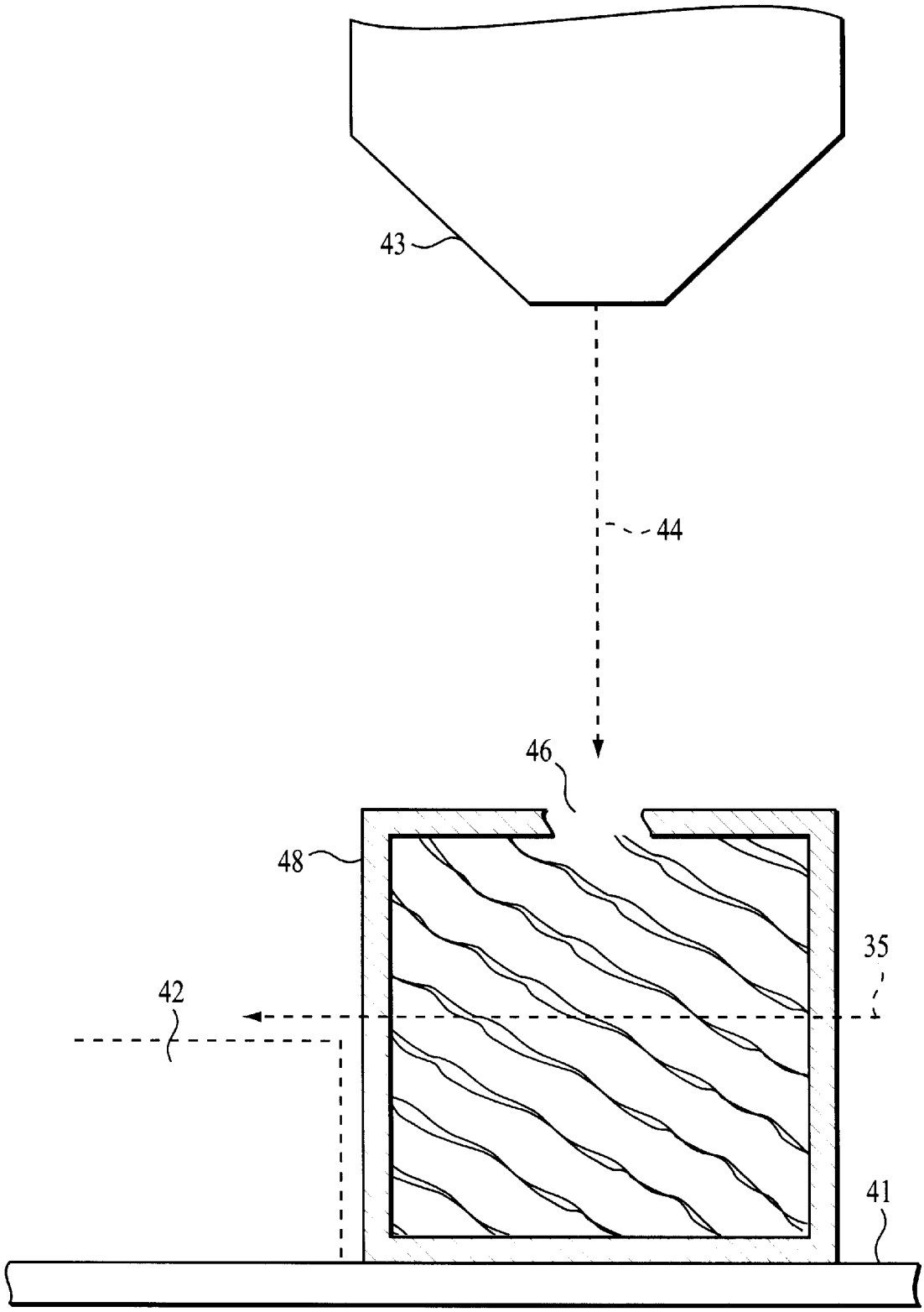
FIG. 4B shows a cross section of a coated toroidal ferrite core following application of a laser.

Turning now to FIG. 4B, which shows an enlarged cross section of the right half of FIG. 4A, the heat generated by the beam 44 from laser 43 burns a hole 46 in the coating 48; also, the rapid rise in temperature caused by the laser on the surface of the core creates fractures 47 in the underlying core material, thus tending to separate the core. It is not known by the applicants how the fractures are structured in microscopic detail. What is known is that when enough heat is applied by the laser 43 upon a core not having a coating 48, the core separates along a surface roughly parallel to the cross section shown in FIG. 4B by alignment arrow 35 and cutting through hole 46. Consequently, the representation of fractures 47 in FIG. 4B is to be understood not as a precise representation but rather with reference to the observed results upon the inductance, described below with reference to FIG. 5, from which it is inferred that the effect of laser beam 44 is to fracture the core. The coating material 48 prevents the fractures 47 from breaking the core into separate pieces.

There are a variety of lasers that may be used to produce laser beam 44. There are pulse lasers (e.g. yag, $CO_2$, helium) which produce a lot of energy in a short burst, although these are relatively difficult to control. In the preferred embodiment of the invention, a laser is used whose energy can be applied to a core in a controlled manner in a production environment. A diode laser has been found to produce satisfactory results, with nominal values of 25 watts applied for 100 milliseconds per hole on a quarter inch core coated with parylene as described above.

Figure 4C:
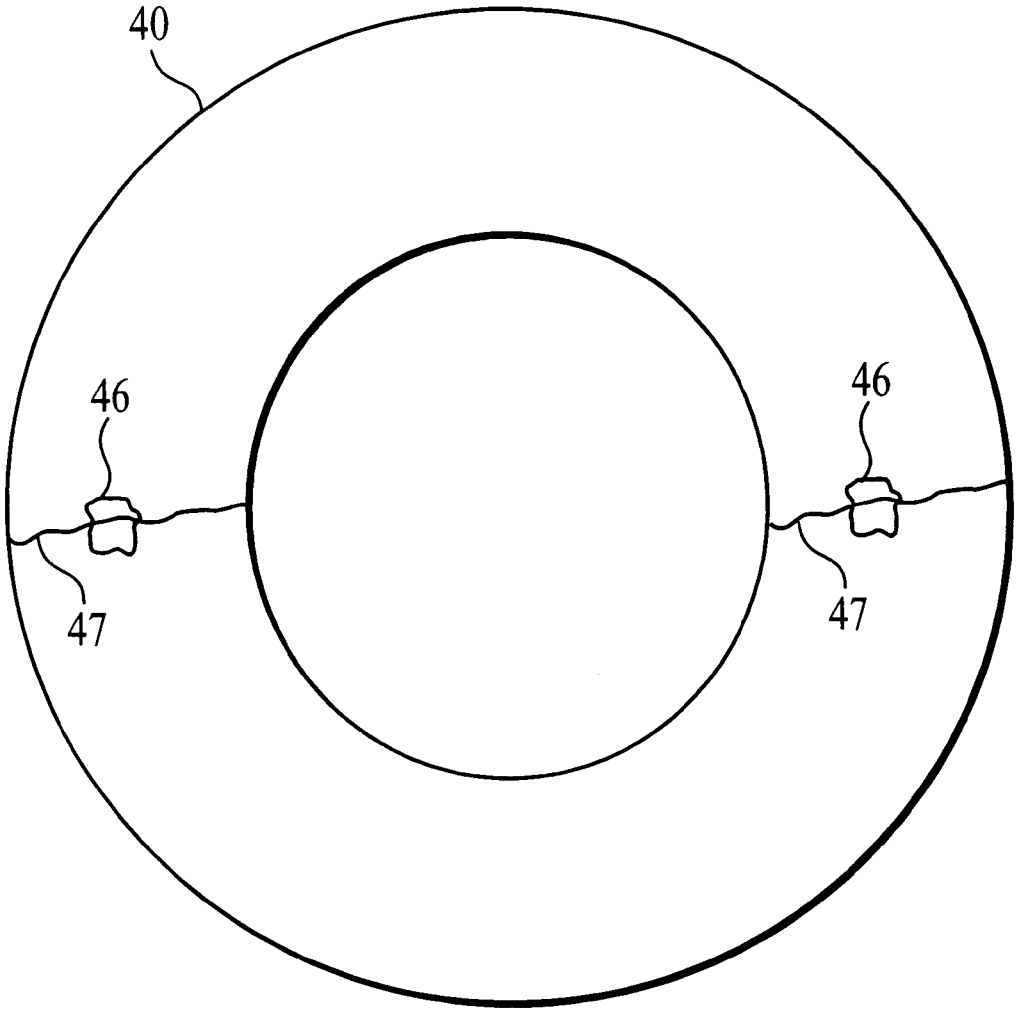
FIG. 4C shows a top view of a coated toroidal ferrite core following application of a laser.

A top view of the core 40 is shown in FIG. 4C, showing laser created holes 46 in the coating material in two places on opposite sides of the core, and also showing a top view of the above described representation of fractures 47 shown in the cross section of FIG. 4B. In some instances a fracture line as indicated the line 47 in FIG. 4B is visible on the surface, along with laser holes 46. Laser holes 46 may be created in one or more places on the surface of the core 40; two holes are shown in FIG. 4C for purposes of illustration of the best mode of practicing the invention.

Figure 5:
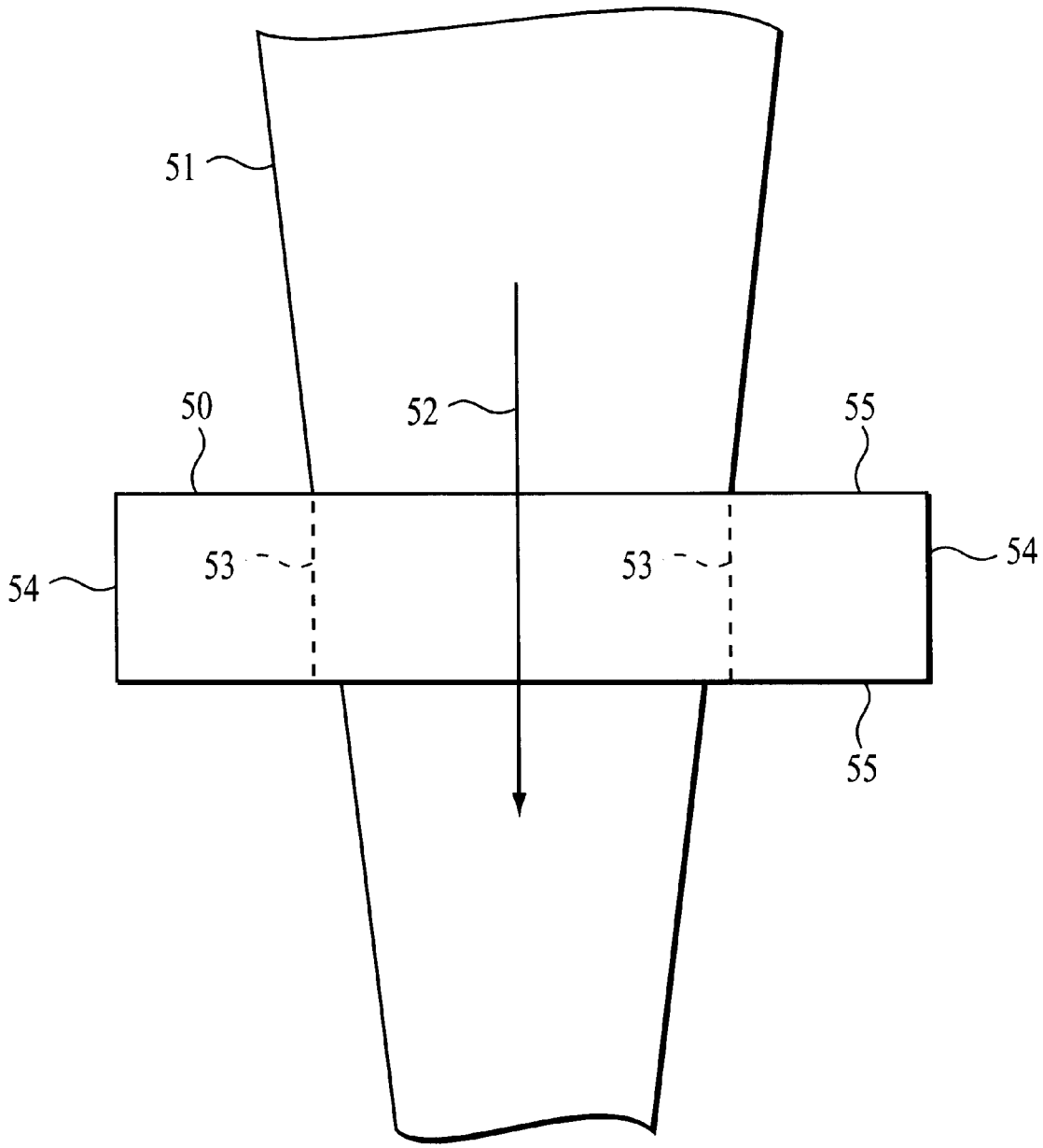
FIG. 5 shows a side view of a core, having a wedge conductor inserted into the center of the core to adjust the core gap in accordance with the invention.

Then the core is opened to set the required inductance. This is shown in FIG. 5, where a wedge 51 is inserted (in the direction shown by arrow 52) perpendicular to the horizontal surfaces 55 into the interior diameter of the core 50. In a preferred embodiment, the wedge 51 is a tapered conductor 51 connected to an electronic measuring device (not shown) for measuring the inductance of the core 50. The interior wall of the core 50 is shown in cross section by the broken lines 53. At some point during insertion in the direction of arrow 52 the increasing width of tapered conductor 51 will become equal to the interior diameter of the core 50 and begin acting as a wedge, placing an outward stress on the core at the interior wall 53. This stress tends to expand the fractures 47 created by the laser beam 44, thereby decreasing the inductance as measured by tapered conductor 51. In the preferred embodiment, two laser fractures on opposite sides of a horizontal surface of the core serve to distribute more evenly the stress created by the wedge. Note that the inductance should not be measured when there is stress on the core, so it is necessary to back the wedge off to read the inductance. If the inductance is too large the wedge is inserted again to further expand the fractures, and then the back off and inductance measuring steps are repeated. If the inductance is too small the core's outer walls 54 are squeezed together to increase the inductance, and then the inductance is measured again. The stabilizing material which has been used to coat the core stretches during the insertion step and contracts when the core is squeezed together, and tends to retain its stretched or contacted condition, thereby allowing the core to substantially retain the inductance level reached from using the wedge to expand the gap or squeezing to reduce the gap. In a preferred embodiment, these steps, as appropriate, are repeated until the desired inductance is reached.

The core gaps are then sealed to prevent further separation or contraction. This can be accomplished by a number of means including vacuum impregnating the core with epoxy. In the vacuum impregnating method, the cores are submerged in a low viscosity epoxy material and then put into a medium to high vacuum. This may be understood with reference to the cross section shown in FIG. 4B. The epoxy within which the cores are submerged is pushed through opening 46 into the core material when the cores—still submerged in the epoxy bath—are returned to atmospheric pressure, thereby filling the fractures 47.

This foregoing method is inexpensive and suited to high volume production. Other sealing methods might include an ultraviolet curing agent, an alpha-cyanoacrylic cement (super glue), or other adhesives that meet the requirements of the transformer.

The cores are then removed from the epoxy and cleaned of excess epoxy. The gap can then be checked again by measuring the inductance, and further adjustments can be made by using the wedge or squeezing the core together, as indicated above. Then the cores are put into an oven to cure the epoxy. The cores now have filled and bonded gaps (so the gaps cannot open or close) and have the same physical and mechanical properties as they started with.

In another embodiment of the invention, the inductance is established by the laser fracturing step, roughly dependent upon the size of the ferrite core, the amount of heat produced by the laser, the number and distribution of laser fractures on the core, and the thickness and heat capacity of the stabilizing material. In this embodiment the step of setting the inductance prior to sealing the core is omitted, and instead the inductance is measured after the core has been sealed. Adjustments may be made before the core is cured.

While the invention has been described in terms of a single preferred embodiment, those skilled in the art will recognize that the invention can be practiced with modification within the spirit and scope of the appended claims.

What is claimed is:

1. A method for gapping a magnetic core, comprising the steps of:

coating a magnetic core with a stabilizing material said magnetic core being made of soft magnetic materials suitable for transformers;

fracturing the coated magnetic core with a laser beam, thereby gapping said coated magnetic core and creating an inductance in said coated magnetic core;

optionally opening the fracture to set said inductance at a desired level; and sealing the core to fix said inductance.

2. The method of claim 1, wherein said stabilizing material is parylene and said laser beam is produced by a diode laser.

3. The method of claim 1, wherein said core is a ferrite toroid, said toroid having an internal diameter, an internal wall, an outside wall, and horizontal surfaces connecting said internal and outside walls.

4. The method of claim 3, where said fracturing is done in one or more places on said horizontal surfaces of said toroid.

5. The method of claim 4, wherein said opening step further comprises the steps of:

monitoring the inductance of said core;

reducing said inductance by inserting a wedge perpendicularly into said internal diameter of said toroid, thereby placing outward stress against said internal wall, thereby expanding said gap;

increasing said inductance by squeezing together said outside wall, thereby contracting said gap;

repeating said inserting and squeezing steps as necessary until said monitoring step indicates said desired inductance.

6. The method of claim 1,wherein said sealing step further comprises the steps of:

submerging said core in a low viscosity epoxy bath;

placing said submerged core in a vacuum;

returning said submerged core to atmospheric pressure, thereby impregnating said fracture with said epoxy;

removing said impregnated core from said epoxy bath;

cleaning excess epoxy off said impregnated core; and curing said impregnated core in an oven.

7. The method of claim 5, wherein said wedge is a non-magnetic conductor and said monitoring step uses said wedge to measure the inductance of said core.

8. The method of claim 5, wherein said monitoring step uses one or more conductors, each said conductor passing through said internal diameter.

9. The method of claim 6, wherein after said removing step and before said curing step the inductance of said impregnated core is measured and adjusted to said desired level.

* * * * *